US006029772A

United States Patent [19]

Takahashi

[11] Patent Number: 6,029,772

[45] Date of Patent: Feb. 29, 2000

[54] LADDER PROVIDED WITH REFLECTORS

[75] Inventor: Eizo Takahashi, Soka, Japan

[73] Assignee: Miyama Kogyo Kabushiki Kaisha, Saitama-ken, Japan

[21] Appl. No.: 09/267,566

[22] Filed: Mar. 12, 1999

[30] Foreign Application Priority Data

Sep. 9, 1998 [JP] Japan ..... 10-270471

[51] Int. Cl.[7] ..... E06C 1/02

[52] U.S. Cl. ..... 182/18; 182/129; 182/228.2

[58] Field of Search ..... 182/18, 228.1, 182/228.6, 129

[56] References Cited

U.S. PATENT DOCUMENTS

| | | | |
|---|---|---|---|
| 165,403 | 7/1875 | Blatt | 182/228.4 |
| 1,729,963 | 10/1929 | Pease | 182/228.4 |
| 2,064,803 | 12/1936 | Grove . | |
| 2,511,077 | 6/1950 | Race | 182/228.4 |
| 4,241,543 | 12/1980 | Foscarini et al. . | |
| 4,610,330 | 9/1986 | Borst . | |
| 4,655,318 | 4/1987 | Bowen . | |
| 4,660,681 | 4/1987 | Zenhausern . | |
| 4,702,349 | 10/1987 | Zenhausern . | |
| 4,771,861 | 9/1988 | Zenhausern et al. . | |
| 4,778,032 | 10/1988 | Takahashi . | |
| 4,869,342 | 9/1989 | Borst . | |
| 5,427,198 | 6/1995 | Walsh | 182/228.4 |
| 5,752,579 | 5/1998 | Takahashi . | |
| 5,772,358 | 6/1998 | Takahashi . | |

FOREIGN PATENT DOCUMENTS

| | | |
|---|---|---|
| 173 227 | 3/1986 | European Pat. Off. . |
| 6-71899 | 7/1994 | Japan . |
| 2700618 | 7/1996 | Japan . |
| 9195295 | 7/1997 | Japan . |
| 10-292412 | 4/1998 | Japan . |

*Primary Examiner*—Alvin Chin-Shue
*Attorney, Agent, or Firm*—Flynn, Thiel, Boutell & Tanis, P.C.

[57] ABSTRACT

A reflector having a plurality of grooves formed on the outer periphery and extending in the axial direction thereof and irregularities formed on the inner periphery thereof to provide secure engagement of the reflector on each cross piece of a ladder. The reflectors are easily attached to each cross piece and can be reliably held thereon thereby preventing accidents when the user goes up or down the ladder. The ladder provided with the reflectors includes a pair of beams, a plurality of cross pieces provided between and connecting the beams, and each cross piece has a plurality of grooves provided on the outer periphery and extending in the axial direction thereof. A reflector is disposed on at least one end of each cross piece at a connecting portion between the cross piece and the respective beam, and each reflector is ring shaped and has a plurality of irregularities formed on the inner periphery at a small diameter portion thereof which engage in the grooves of the respective cross piece. Reflector portions having irregularities are also formed on the inner periphery of the reflector at a large diameter portion thereof, and a plurality of grooves are formed on the outer periphery and extend in the axial direction thereof.

7 Claims, 3 Drawing Sheets

LADDER PROVIDED WITH REFLECTORS

BACKGROUND OF THE INVENTION

1. Field of the Invention

The present invention relates to a ladder provided with reflectors, and more particularly to a ladder comprising a pair of beams and a plurality of lateral cross pieces serving as footholds and connecting both beams.

2. Prior Art

A conventional ladder comprising a pair of beams and a plurality of cross pieces serving as footholds for connecting both beams and provided with reflectors is known as disclosed in Japanese Patent No. 2700618. In this conventional ladder, a plurality of grooves are formed on the outer periphery of each reflector in the circumferential direction so that the reflectors can perform diffused reflection.

If the conventional ladder provided with reflectors on each cross piece or foothold is used underground or at a dark spot during the night, the contour of the ladder can be easily distinguished. However, when a person gets his or her foot or feet on the reflectors or the person grips the reflectors by hand or hands, there is a possibility that the feet or hands of the person may slide off of the ladder because of the presence of a plurality of grooves formed on the outer peripheries of the reflectors in the circumferential direction. Accordingly, the person is put in danger when the person goes up and down the ladder, and there is a possibility of the occurrence of an accident, for example the person may fall down from the ladder. Further, since special attention is not paid to the engagement between each cross piece and the reflectors, there is a possibility that the reflectors may turn or rotate relative to each cross piece and the reflectors are not securely held by each cross piece when placing the feet or foot on or off of the reflectors or gripping the reflectors with the hand or hands.

SUMMARY OF THE INVENTION

The present invention has been made in view of the problems of the conventional ladder provided with reflectors, and it is an object of the present invention to provide a ladder comprising a pair of beams, lateral cross pieces each provided between the beams and having a plurality of grooves in the axial direction thereof, and reflectors each having a plurality of grooves formed on the outer peripheral surface thereof in the axial direction and irregular reflecting portions provided on the inner peripheral surfaces thereof, wherein reflectors are surely engaged in each cross piece. With this construction of the ladder, a person is safe and is not put in danger when going up or down the ladder, and the reflectors can be easily attached to each cross piece and can be reliably held by each cross piece.

To achieve the above object, the ladder of the present invention comprises a pair of beams, a plurality of cross pieces provided between and connecting the beams, each cross piece having a plurality of grooves provided on the outer periphery which extend in the axial direction thereof, and reflectors disposed on at least one end of each cross piece at connecting portions between the cross piece and the respective beams, wherein each reflector is ring-shaped and has a plurality of irregularities formed on the inner periphery at a small diameter portion thereof which engage in the grooves of each cross piece, and reflector portions having irregularities formed on the inner periphery at a large diameter portion thereof, and a plurality of grooves formed on the outer periphery which extend in the axial direction thereof.

PREFERRED EMBODIMENT OF THE INVENTION

Figure 1:
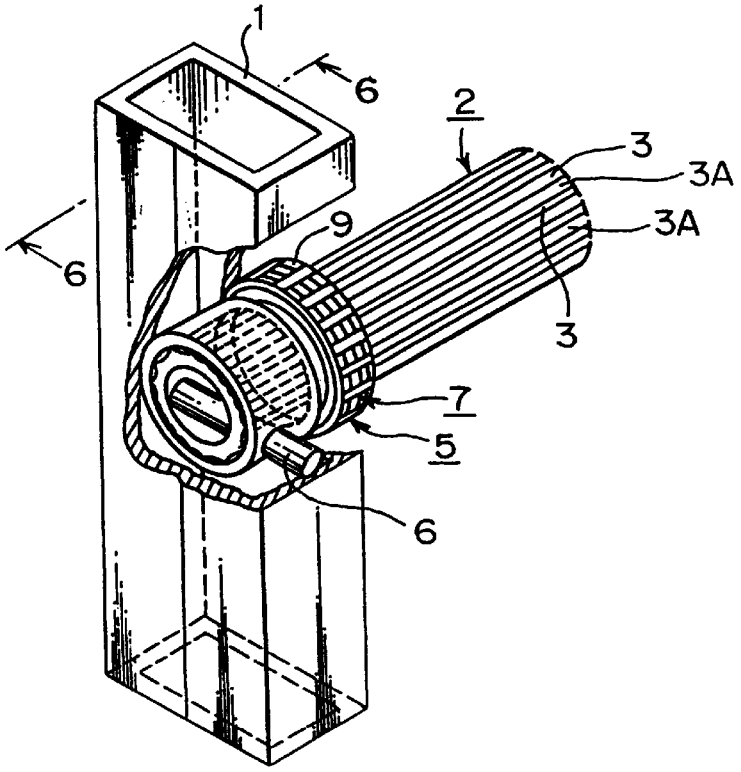
FIG. 1 is a fragmentary perspective view of a ladder provided with reflectors according to a preferred embodiment of the invention.

A ladder provided with reflectors according to a preferred embodiment of the invention will be now described with reference to FIGS. 1 to 5.

In these figures, reference numeral 1 depicts the pair of beams which are positioned at both side of each cross piece 2 serving as a foothold, wherein a plurality of cross pieces 2 are arranged between and interconnect the beams 1. A plurality of grooves 3 are formed in the outer periphery of each cross piece 2. The grooves 3 are uniformly spaced about the circumference of the respective cross piece 2 and each groove 3 extends in the axial direction thereof.

Each cross piece 2 additionally includes a plurality of outwardly projecting and axially extending ribs 3A. The ribs 3A and grooves 3 are arranged in an alternating manner about the circumference of the respective cross piece 2.

Denoted by 4 are holes defined in each beam 1 which holes 4 open at an inwardly facing side thereof and extend into the inside thereof. The opposite terminal ends of each cross piece 2 are inserted into the respective holes 4. Respective ring-shaped reflectors 5 are engaged in and arranged on both ends of each cross piece 2 adjacent the connecting portions between the respective beam 1 and each cross piece 2.

Figure 2:
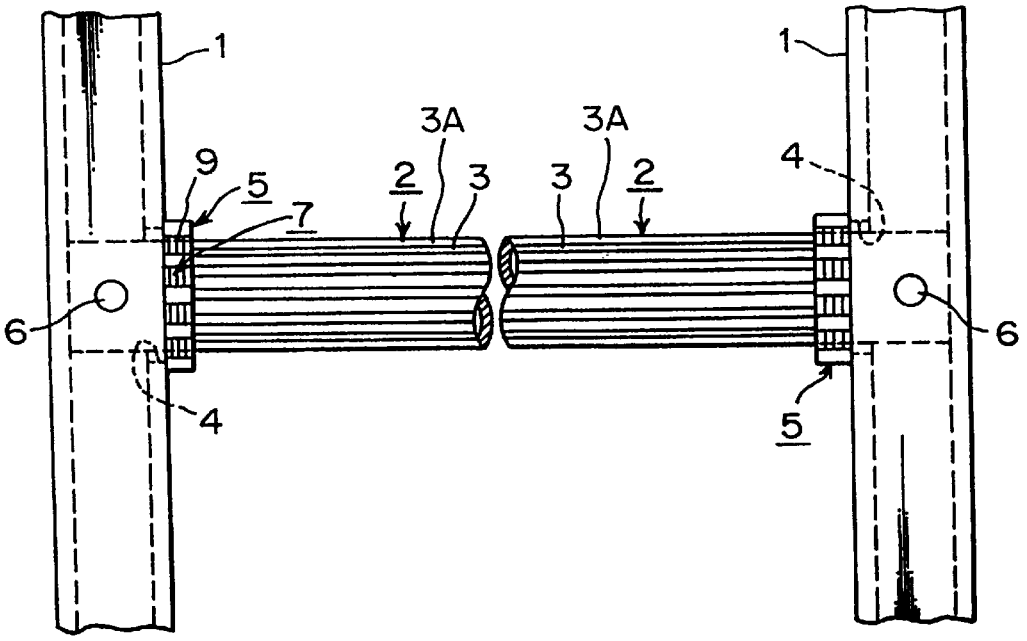
FIG. 2 is a fragmentary front view of the ladder provided with reflectors.
Figure 3:
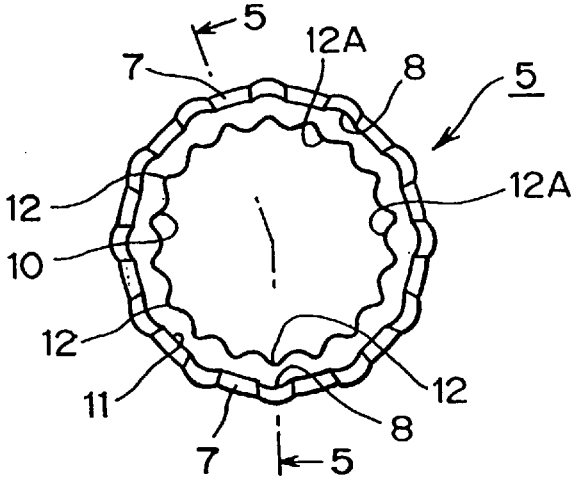
FIG. 3 is a plan view of a reflector.
Figure 4:
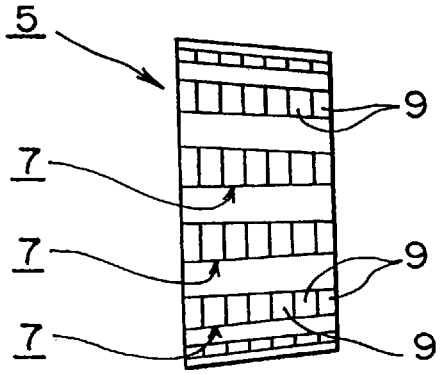
FIG. 4 is a side elevational view of the reflector shown in FIG. 3.
Figure 5:
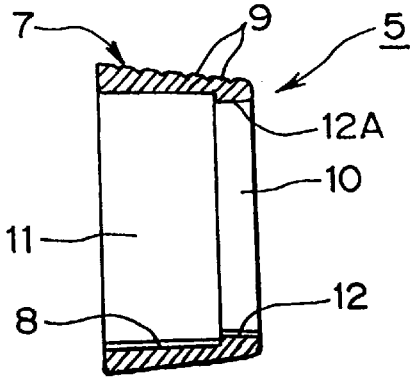
FIG. 5 is a sectional view taken along the line 5—5 in FIG. 3.

The reflectors 5 may be positioned adjacent the inner sides of both beams 1 as shown in FIG. 2, or may be positioned only at the inner side of one beam 1. Furthermore, in accordance with an alternative embodiment, the end portions of each cross piece 2 may be reduced in diameter, and the ring-shaped reflectors 5 may be engaged in and disposed on these end portions of reduced diameter, such that the outer peripheries of the reflectors 5 are flush with those of each cross piece 2.

Both ends of each cross piece 2 are retained relative to the beams 1 by pins 6 which extend into the holes 4 defined in the beams 1 and through the ends of the cross piece 2 in a state where the reflectors 5 are engaged in the outer periphery of each cross piece 2. Both ends of each cross piece 2 penetrate the respective beams 1, and the cross pieces 2 are retained or secured relative to the beams 1 by pins 6, the ends of which pins 6 engage in openings in the opposite outer sides of the respective beams 1.

The ring-shaped reflectors 5 are engaged in the outer periphery of each cross piece 2. The reflectors 5 have a plurality of grooves 7 formed along the outer peripheries thereof which extend in the axial direction similar to the grooves 3 of each cross piece 2. In addition, the grooves 7 are uniformly spaced about the circumference of the respective reflector 5. The reflectors 5 are made, for example, of polycarbonate, acrylic resin, or a transparent high polymer material. The reflectors 5 have a plurality of irregular grooves 12 and irregular reflector portions 8 provided at the inner peripheries thereof as discussed below. A plurality of projections 9 are formed along each groove 7 about the circumference of the reflector 5 so that light is diffused thereon. The inner diameter of each reflector 5 is axially stepped and in this regard has a small diameter portion 10 and a large diameter portion diameter 11, wherein the grooves 12 extend a short axial distance along the small diameter portion 10. The reflectors 5 also include axially elongate, rib-like projections 12A which alternate with the grooves 12 about the inner periphery thereof at portion 10 so as to conform to the outer peripheral shape of each cross piece 2. These projections 12A engage in the respective grooves 3 of the cross piece 2, and likewise the ribs 3A of the cross piece 2 engage in the grooves 12 of the reflector 5 to permit the ring-shaped reflectors 5 to be reliably secured to the cross piece 2. The large diameter portion 11 is slightly greater than the outer diameter of each cross piece 2 and the reflector portions 8 are located along portion 11. When the reflectors 5 are engaged in or mounted on each cross piece 2, minute spaces are defined or formed radially between the outer surface of each cross piece 2 and the inner surface or large diameter portion 11 of the reflectors 5 so that the reflection efficiency of light can be improved by these spaces. In this regard, reflector portions 8, in the illustrated embodiment, are elongate grooves or channels which extend in the axial direction along large diameter portion 11. In addition, the reflectors 5 are preferably installed on the respective cross piece 2 so that the reflector portions 8 thereof face inwardly or away from the respective beam 1.

Since the ladder of the present invention is structured as set forth above, even if light of low intensity is reflected by the reflectors 5 disposed on each cross piece 2 of the ladder when the ladder is used underground or at a dark spot, the entire contour of the ladder is visible. As a result, the existence of the ladder can be confirmed to avoid collision of a person with the ladder.

Even if both feet or a foot of the person is placed on the cross piece 2 or the reflectors 5, or alternatively if the cross piece 2 or the respective reflectors 5 are gripped by hands when the person goes up or down the ladder, the feet and hands are prevented from slipping by the axially extending grooves 3 and 7 respectively formed at the outer peripheries of the respective cross pieces 2 and reflectors 5, thereby preventing an accident such as the person falling from the ladder. Further, the small diameter portion 10 of each reflector 5 is engaged in the outer periphery of each cross piece 2, so that the reflector 5 does not rotate relative to the respective cross piece 2 even if a foot or feet are placed on the reflector 5, or the reflector 5 is gripped by hands, so that the reflectors 5 are reliably held by each cross piece 2.

Figure 6:
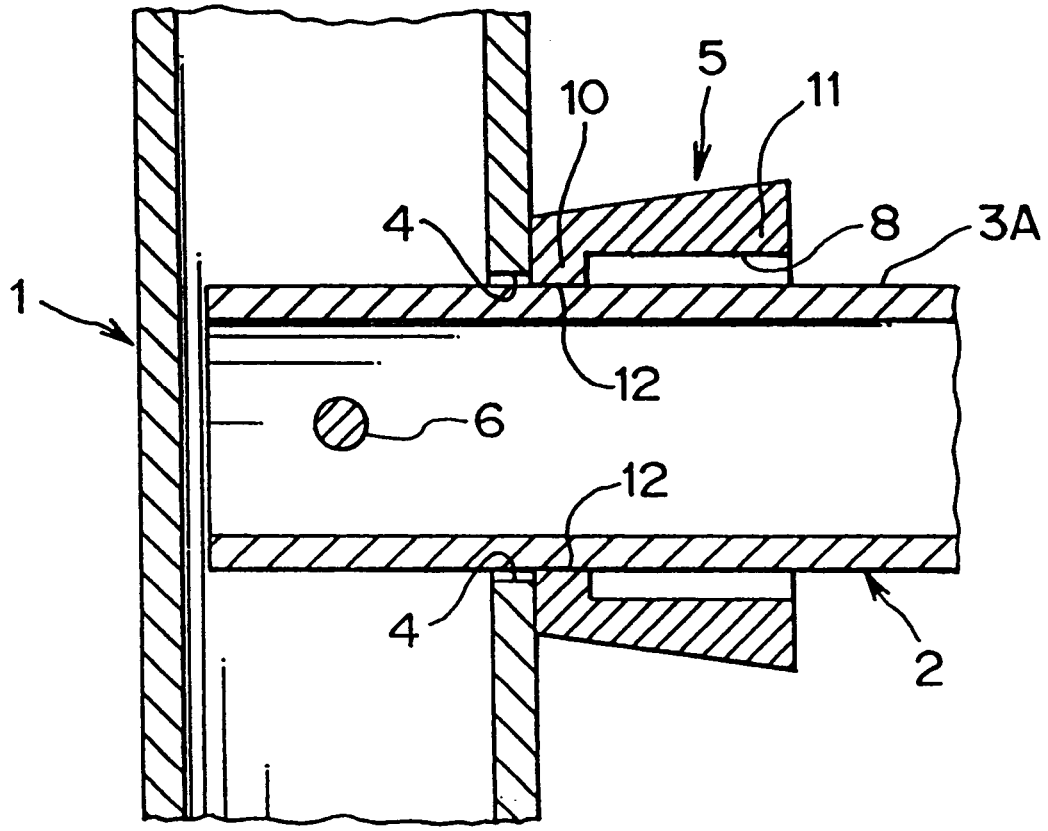
FIG. 6 is an enlarged sectional view taken along the line 6—6 in FIG. 1.

FIG. 6 shows the interlocking engagement of the cross piece ribs 3A with the grooves 12 of the small diameter portion 10 of the reflector 5. In addition, the reflectors 5 are arranged so that the end face thereof adjacent small diameter portion 10 abuts the inwardly facing surface of the respective beam 1.

According to the present invention, the ladder includes a plurality of cross pieces provided between and connecting the beams, each cross piece having a plurality of grooves provided on the outer periphery and extending in the axial direction thereof, and reflectors disposed on at least one end of each cross piece at connecting portions between each cross piece and the respective beams, each reflector being ring shaped and having a plurality of irregularities formed on the inner periphery at the small diameter portion thereof which engage in the grooves of each cross piece, and reflector portions additionally having irregularities formed on the inner periphery at the large diameter portion thereof, and a plurality of grooves formed on the outer periphery in the axial direction thereof. As a result, the entire contour of the ladder can be clearly confirmed when the ladder is used underground or at a dark spot, and even if feet or a foot of the person is placed on each cross piece or the associated reflectors, or if each cross piece or the reflectors are gripped by hands when the person goes up or down the ladder, the feet and hands are prevented from sliding by axially extending grooves formed at the outer periphery of the cross piece and the reflectors, thereby preventing the person from being involved in an accident such as falling from the ladder. Still further, since the reflection efficiency of the reflectors can be improved and the reflectors may be merely engaged in the outer periphery of each cross piece 2, the reflectors can be easily attached to each cross piece 2 and the reflectors can be reliably held by each cross piece 2.

It will be appreciated that the reflectors 5 need not be provided with an outer surface having a frustoconical as illustrated herein, but may instead be provided with an outer surface having a constant diameter, or other configuration.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A ladder comprising:

a pair of upright beams;

a plurality of generally horizontally oriented cross pieces extending between and inter-connecting the beams, each cross piece defining a longitudinal axis and having a plurality of axially extending grooves provided on an outer periphery thereof; and a ring-shaped reflector disposed about at least one end of each said cross piece at a connecting portion between each said cross piece and the respective beam, said reflector having an inner periphery and an outer periphery spaced from and surrounding said inner periphery, said inner periphery including a first portion disposed adjacent the respective beam and having a first diameter and a second portion having a second diameter greater than said first diameter, each said reflector having a plurality of projections formed on said first portion of said inner periphery thereof which engage in the respective grooves of the respective cross piece to prevent rotation of said reflector relative to said cross piece, said diameter of said second portion being greater than an outer diameter of the respective cross piece such that an annular space is defined therebetween which opens away from the respective beam, and irregularly contoured reflector areas being formed on said second portion of the inner periphery to reflect light entering said annular space, and a plurality of grooves being formed on said outer periphery of said reflector and extending in the axial direction and generally parallel to said grooves of the respective cross piece.

2. The ladder of claim 1, wherein each said cross piece includes a plurality of axially extending and elongate ribs each disposed between an adjacent pair of said grooves of said cross piece, said ribs engaging in respective axially extending grooves formed on said first portion of said inner periphery of said reflector in an alternating manner with said projections.

3. The ladder of claim 1, wherein said first and second portions of said reflector are axially adjacent one another to provide said inner periphery with a stepped configuration.

4. The ladder of claim 1 wherein said beam adjacent said reflector has a pair of oppositely facing and upright front and rear walls each having an inner longitudinal and vertically oriented edge adjacent the respective cross pieces and a side wall which extends between and interconnects said front and rear walls, each said reflector having a first end face disposed adjacent said first portion of said inner periphery and a second end face facing away from said first end face, said first end face abutting an inwardly facing surface of said side wall and said reflector projecting axially inwardly past said inner longitudinal edges of the respective front and rear walls such that said second end face is horizontally spaced from said inner longitudinal edges.

5. The ladder of claim 1 wherein said grooves of said outer periphery of the respective reflectors are spaced-apart from one another about the circumference of said reflector, and reflector areas are formed within the respective grooves of said reflector.

6. A ladder comprising:

a pair of upright beams;

a plurality of generally horizontally oriented and vertically spaced cross pieces extending between and interconnecting said beams, each said cross piece defining a longitudinal axis and having a plurality of axially extending grooves provided on an outer periphery thereof; and an annular reflector disposed about an end of one of said cross pieces at a junction of said one cross piece and the respective beam, said reflector having an inner periphery and an outer periphery spaced from and surrounding said inner periphery, said reflector having a plurality of projections formed on said inner periphery which engage in the respective grooves of said one cross piece to prevent rotation of said reflector relative to said one cross piece, and a plurality of grooves formed on said outer periphery and extending in the axial direction and generally parallel to said grooves of said one cross piece, said inner periphery including a portion having reflectors thereon which define reflector areas, said portion having a diameter greater than an outer diameter of said one cross piece such that an annular space is defined between said inner periphery and said one cross piece, said annular space opening away from the respective beam to reflect light entering said annular space.

7. The ladder of claim 6 wherein terminal ends of each said cross piece are secured to the respective beam by a pin which extends through openings defined in respective opposed side walls of the respective beam and also through the terminal end of the respective cross piece.

* * * * *